United States Patent [19]

Wada

[11] 3,979,998

[45] Sept. 14, 1976

[54] HYDRAULIC ACTUATORS EQUIPPED WITH CUSHIONING MEANS

[75] Inventor: Hideo Wada, Fujisawa, Japan

[73] Assignee: Caterpillar Mitsubishi Ltd., Tokyo, Japan

[22] Filed: Sept. 27, 1974

[21] Appl. No.: 509,989

[30] Foreign Application Priority Data

Oct. 2, 1973 Japan ..... 48-110214

[52] U.S. Cl. ..... 91/26; 91/399; 91/408; 91/436; 91/437

[51] Int. Cl.[2] ..... F15B 15/22

[58] Field of Search ..... 91/408, 409, 406, 23, 91/399, 25, 26, 407, 436, 437; 137/513.3

[56] References Cited

UNITED STATES PATENTS

| | | | |
|---|---|---|---|
| 2,965,133 | 12/1960 | Rice | 91/437 |
| 3,396,635 | 8/1968 | Darling | 91/451 |
| 3,470,792 | 10/1969 | Darling | 91/408 X |
| 3,518,829 | 7/1970 | Kamner | 91/26 |
| 3,631,761 | 1/1972 | Rumsey | 91/408 |
| 3,777,879 | 12/1973 | Dehne | 91/437 |
| 3,805,825 | 4/1974 | Lovingham | 137/513.3 |
| 3,887,160 | 6/1975 | Cusveller | 91/408 X |

*Primary Examiner*—Martin P. Schwadron
*Assistant Examiner*—Abraham Hershkovitz
*Attorney, Agent, or Firm*—Phillips, Moore, Weissenberger, Lempio & Strabala

[57] ABSTRACT

A hydraulic actuator comprising a pair of pressure oil chambers each of which has a cushioning port, the two cushioning ports being connected to each other through a cushioning means. The cushioning means includes a pair of cracking valves whose closing pressure is lower than its opening pressure and a pair of restricting means for restricting the flow of a pressure oil provided with regard to said cracking valves. This structure permits an output means for the actuator to be stopped smoothly as a result of fully absorbing the inertial energy that accompanies the output means.

11 Claims, 6 Drawing Figures

HYDRAULIC ACTUATORS EQUIPPED WITH CUSHIONING MEANS

BACKGROUND OF THE INVENTION

1. Field of the Invention

This invention relates to a hydraulic actuator, and ore specifically to a hydraulic actuator suitable for :ciprocating rotation or reciprocating straight line ovement of an implement, such as a back-hoe attach- ent, provided on an earth-moving machine or con- ..ruction machine.

2. Description of the Prior Art

Usually, implements such as a back-hoe attachment :ovided on an earth-moving or construction machine ·e operated by a reciprocably straight-moving or ro- .ting hydraulic actuator. In order to stop such an im- lement smoothly at its stroke end or at any desired ɔsition in its stroke, it is desired to reduce impact by roperly absorbing the inertial energy caused by its iotion.

With a view to realizing this desire, hydraulic actua- ɔrs equipped with a cushioning means were proposed. he cushioning means of the known hydraulic actuator ɔmprises a cushioning port provided in each of two ressure oil chambers of the actuator, a line connecting ach cushioning port to a reservior, and a relief valve isposed within each line. When the implement in such conventional actuator approaches its stroke end and ıerefore, an output means of the actuator, such as a iston, approaches its stroke end, a main port in a ressure oil chamber on the discharge side (that is, the ressure oil chamber whose volume has descreased as a esult of the movement of the output means) is closed ɔ increase the pressure of the chamber on the dis- charge side. When this pressure increases beyond a ɔrescribed pressure of a relief valve located in the line onnecting this chamber to the reservior, the relief alve is opened, whereby the pressure oil present in this ·ressure oil chamber passes through the cushioning ɔort and returns to the reservior through the relief alve. Upon the return of the pressure oil to the reserv- ɔr, the pressure of the pressure oil chamber on the ·ischarge side decreases below the prescribed pressure ıf the relief valve, this relief valve is again closed. Vhen a control valve is switched over to its neutral ɔosition in order to stop the implement at a desired ɔosition in its stroke, and therefore, to stop the output neans at a desired position in its stroke, the main ports ıf the two pressure oil chambers are closed. Thus, in he same manner as in the above example, the pressure ıf the pressure oil chamber on the discharge side in- reases to return the pressure oil therein to the reser- oir through the cushioning port and the relief valve.

The cushioning means described above reduces im- ɔact by absorbing the inertial energy of the implement hrough the flow restricting action of the relief valve luring the passing of pressure oil through the relief alve. However, this conventional cushioning means annot perform a fully satisfactory cushioning. In other vords, the conventional cushioning means cannot stop he implement smoothly as desired by fully absorbing he inertial energy of the implement, that is, the inertial :nergy of the output means. This is because the open- ng pressure and the closing pressure of a relief valve vhich restrict the flow of the pressure oil and absorbs he inertial energy are substantially the same, and equal he prescribed pressure of the relieve valve. Accordingly, the valve is closed at substantially the same pressure as the opening pressure, and even after the closing of the relief valve, the inertial energy remains and causes impact to the implement, and thus to the output means. Inertial energy can be fully absorbed at a substantially low pressure setting, but in turn, induced pressure oil would be more likely to escape from the oil chamber, resulting in deterioration of working efficiency. It is not wise therefore to determine the pressure of the relief valve at a value lower than a reted one.

There was also proposed a hydraulic actuator in which a cushioning port of a pressure oil chamber is connected to a reservior by as first line provided with a first relief valve and also to a control valve by a second line provided with a second relief valve and an orifice placed alongside the relief valve. When the implement (therefore, its output means) approaches its stroke end, a main port of a pressure oil chamber at the discharge end of the actuator is closed, and a pressure oil in the pressure oil chamber is returned through the second line and the control valve. When the flow of the pressure oil passing through the second line is restricted by the above second relief valve and the orifice, the inertial energy of the implement is absorbed. Since the pressure oil flows through the orifice in this hydraulic actuator even after the closing of the second relief valve, the inertial energy of the implement is absorbed almost satisfactorily at its stroke end. However, when the control valve is brought to its neutral position in order to stop the implement at a desired position in its stroke, the second relief valve and the orifice are in the closed state, and therefore, the pressure oil in the pressure oil chamber on the discharge side is returned to the reservoir through the first line. The flow of the pressure oil passing through the first line is restricted by the first relief valve in the same way in the case of the above-mentioned actuator thereby to absorb the inertial energy of the implement. Since the flow of the pressure oil passing through the first line is restricted only by the first relief valve whose closing and opening pressure are substantially equal to each other, this hydraulic actuator can neither absorb the inertial energy of the implement sufficiently when stopping the implement at a desired position in its stroke. When an orifice is provided alongside the first relief in the first line, the pressure oil also escapes when being introduced into the pressure oil chamber, thereby to cause pressure loss. It is evident therefore that an orifice cannot be provided in the first line. Furthermore, this hydraulic actuator requires two relief valves for each pressure oil chamber, and thus disadvantageously has a relatively complicated structure.

SUMMARY OF THE INVENTION

Accordingly, it is an object of this invention to provide a hydraulic actuator equipped with a cushioning means that can perform a cushioning action of satisfactorily absorbing the inertial energy of an output means not only when stopping the output means at its stroke end but also when stopping it at a desired position in its stroke.

Another object of this invention is to provide a hydraulic actuator equipped with a relatively compact cushioning means having the above function.

According to this invention, there is provided a hydraulic actuator including a main body, an output means reciprocably disposed within said main body and first and second chambers defined by said output means within said main body, said first chamber having a first main port which is closed when said output means approaches one of its stroke ends and a first cushioning port provided so that it remains open after said first main port has been closed, said second chamber having a second main port which is closed when said output means approaches its other stroke end and a second cushioning port provided so that it remains open after said second main port has been closed; and said first and second main port being connected to a pressure oil source and an reservoir through a control valve; characterized in that said first cushioning port and said second cushioning port are connected to each other through a cushioning means, and said cushioning means comprises a first cracking valve which opens when the pressure on the side of said first cushioning port exceeds a first predetermined pressure and is closed when it becomes lower than said first predetermined pressure, a first restricting means which restricts the flow of a pressure oil from said first cushioning port to said second cushioning port while said first cracking valve is open, a second cracking valve which opens when the pressure on the side of said second cushioning port exceeds said first predetermined pressure and is closed when it becomes lower than said second predetermined pressure, and a second restricting means which restricts the flow of the pressure oil from said second cushioning port to said first cushioning port while said second cracking valve is open.

The basic principle of this invention can be applied both to the swing type and reciprocating type. The term "reciprocating movement", used in the present application, therefore, denotes not only a mere straight-line reciprocating movement but also a rotating reciprocating movement. Furthermore, the term "cracking valve", as used in the present application, means a valve whose closing pressure is lower than its opening pressure.

Preferably, each of the first and second restricting means is made up of a relief valve whose prescribed pressure is lower than the opening pressure of the cracking valve, or an orifice, or a combination of a relief valve whose pressure setting is lower than the opening of the cracking valve and higher than the closing pressure of the cracking valve.

Other objects and advantages of this invention will become apparent from the following description taken in conjunction with the accompanying drawings which illustrate preferred embodiments of the present invention.

DETAILED DESCRIPTION OF PREFERRED EMBODIMENTS

Figure 1:
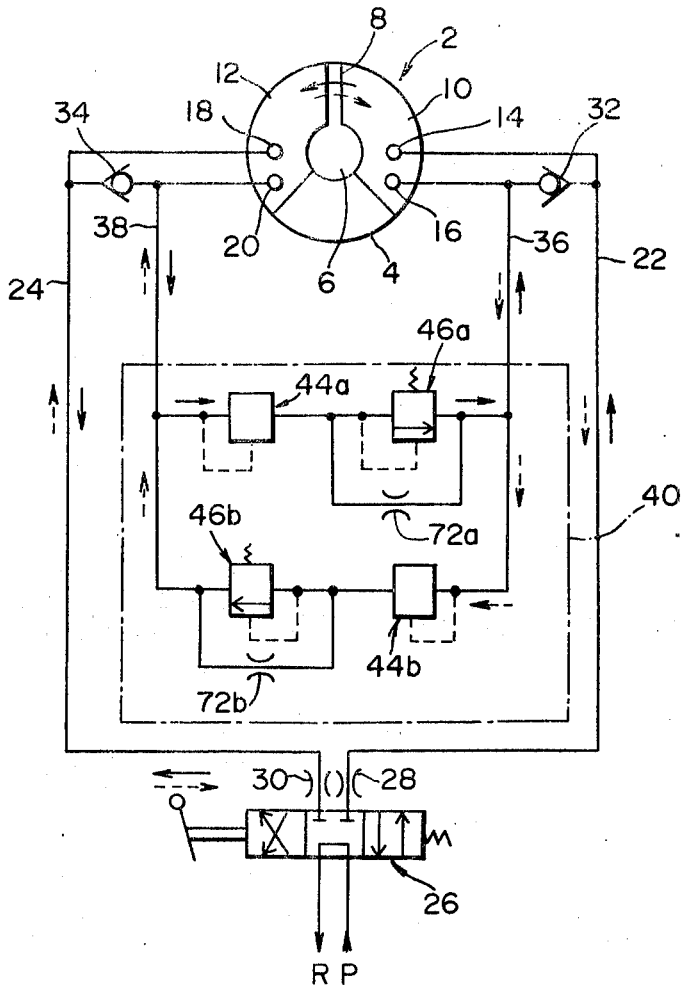
FIG. 1 illustrates a simplified hydraulic circuit of a reciprocatingly rotating hydraulic actuator of this invention equipped with a cushioning means.

A reciprocatingly rotating hydraulic actuator constructed in accordance with this invention will be described by referring to FIG. 1.

A reciprocatingly rotating hydraulic actuator 2 includes a main body 4, a shaft (i.e., an output means) 6 disposed rottatbly within the main body 4, and two pressure oil chambers 10 and 12 defined within the main body by a vane 8 of the shaft 6. The shaft 6 is connected, for example, to an implement such as a back-hoe attachment (not shown), and drives it so that it rotates reciprocatingly. The chamber 10 includes a main port 14 and a cushioning port 16, and the chamber 12 includes a main port 18 and a cushioning port 20. The main port 14 of the chamber 10 is so positioned that it is closed by the vane 8 when the shaft 6 rotates clockwise in FIG. 1 to approach one of its stroke ends. The main port 18 of the chamber 12 is so positioned that it is closed when the shaft 6 rotates counterclockwise in FIG. 1 to approach its other stroke end. Furthermore, the cushioning port 16 and the cushioning port 20 are so positioned that they remain open after the main ports have been closed by the vane 8; in other words, they are disposed at positions in proximity to the stroke ends of the shafts 6.

The main port 14 of the chamber 10 and the main port 18 of the chamber 12 are connected to a direction control valve 26 of the 4-port 3-position spring center type, for example, by lines 22 and 24 including orifices 28 and 30 for lowering the pressure acting on the actuator to proper values. The dirction control valve 26 is connected to a pressure oil source (that is, a pump and a reservoir) by the lines equipped with a safety valve (not shown). The cushioning port 16 of the chamber 10 and the cushioning port 20 of the chamber 12 are connected to the lines 22 and 24 respectively through check valves 32 and 34 respectively.

Furthermore, the cushioning port 16 and the cushioning port 18 are connected to each other by lines 36 and 38 through a cushioning means generally shown at 40 and forming the principal part of the present invention.

Now, the cushioning means 40 will be described in detail with reference to FIG. 2 taken together with FIG. 1.

Figure 2:
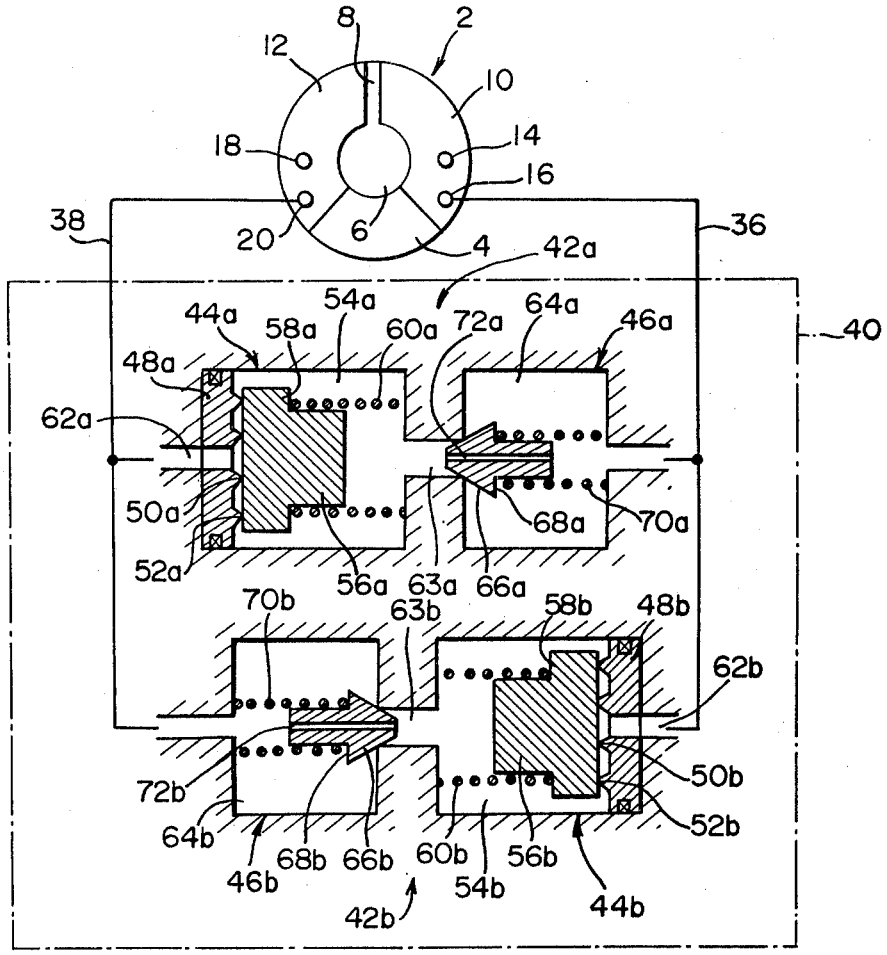
FIG. 2 is a sectional view showing the details of the cushioning means of the hydraulic actuator shown in FIG. 1.

The cushioning means 40 shown in FIGS. 1 and 2 is made up of a first cushioning section 42*a* equipped with a cracking valve 44*a* and a relief valve 46*a* and a second cushioning section 42*b* equipped with a cracking valve 44*b* and a relief valve 46*b*. The cracking valve 44*a* consists of a valve seat 48*a* having two concentric annular projections 50*a* and 52*a*, a valve member 56*a* having a shoulder 58*a* disposed in a bore 54*a*, and a compression spring 60*a* provided between one end wall of the bore and the shoulder 58*a* of the valve member 56*a* and urging the valve member 56*a* against the annular projections 50*a* and 52*a* of the valve seat 48*a*. The valve seat 48*a* has been formed therein an opening 62*a* which communicates with a line 38. The diameter of the opening 62*a* is somewhat smaller than that of the annular projection 50*a*. The inside of the bore 54 communicates with a relief valve 46*a* through a pressure oil passageway 63*a*. The valve member 56*a* of the cracking valve 44*a* is moved in the right direction in FIG. 1 when the pressure inside the line 38 exceeds the rated value, and the force that acts on an area within the annular projection 50*a* surpasses the force of the spring 60*a*. This results in the opening of the cracking valve 44*a*. The valve member 56*a* which has been moved in the right direction is maintained in the open state even after the pressure inside the line 38 has decreased to below the rated value. This open state lasts until the amount of the flowing oil is reduced markedly by the action of the oil that flows from the opening 62*a* of the seat 48*a* to the pressure oil passageway 63*a* through the bore 54*a*. In other words, once the cracking valve 44*a* has been opened by the pressure above the delivery pressure, it remains open until the pressure becomes considerably lower than the rated value, preferably until it approaches 0. The relief valve 46*a* which constitutes a restricting means for the flow of oil consists of a bore 64*a* one end of which communicates with the pressure oil passageway 63*a* and the other end of which communicates with a line 36, a valve member 66*a* having a shoulder 68*a* disposed with the bore 64*a*, and a compression spring 70*a* provided between one end wall of the bore 64*a* and the shoulder 68*a* of the valve member 66*a* and urging the valve member 66*a* in the left direction in FIG. 2. Preferably, an orifice 72*a* is provided in the valve member 66*a*. When the pressure inside the pressure oil passageway 63*a* exceeds a rated pressure, the valve member 66*a* is moved in the right direction in FIG. 2 in resistance to the force of the spring 70*a*, and opens. When the pressure inside the pressure oil passageway 63*a* decreases to below the rated pressure, the valve member 66*a* is returned to the position shown in FIG. 2 by the action of the spring 70*a*, and is thus closed. Since in the embodiment shown in FIG. 2, the orifice 72*a* is provided in the valve 66*a*, the pressure oil passageway 63*a* communicates with the line 36 through the orifice 72*a* even when the valve member 66*a* is closed at the position shown in FIG. 2 so that the pressure oil can flow from the passageway 63*a* to the line 36. For the reason to be given later on, the rated pressure of the relief valve 46*a* is preferably lower than the opening pressure of the cracking valve and higher than its closing pressure. Because the cracking valve 44*a* is disposed upstream of the relief valve 46*a*, the rated pressure of the relief valve 46*a* can be maintained at a very low value without causing a loss in pressure. Accordingly, the provision of the orifice 71*a* may be omitted.

The second cushioning section 42*b* is the same as the first cushioning section 42*a* except that its constituent elements are arranged in the reverse direction with respect to the lines 36 and 38. Therefore, it will not be described in detail in this specification.

Now, the operation of the hydraulic actuator illustrated in FIGS. 1 and 2 will be described below. When in the state shown in FIG. 1, the control valve 26 is moved in the direction shown by a solid-line arrow to connect the chamber 10 to a pump and the chamber 12 to a reservoir, the pressure oil is fed from the main port 14 and the cushioning port 16 to the chamber 10, and the pressure oil in the chamber 12 is returned to the reservoir from the main port 18. This causes the rotation of the shaft 6 in a direction shown by a solid-line arrow. When the shaft 6 rotates and approaches one end of its strokes, the vane 8 of the shaft 6 closes the main port 18 of the chamber 12 on the discharge side. Even after the main port 18 of the chamber 12 has been closed by the vane 8, the shaft 6 remains rotating in the direction shown by a solid-line arrow by the inertial energy accompanying the shaft 6. As a result, the pressure inside the chamber 12, and therefore, the pressure inside the line 38 which communicates with the chamber 12 through the cushioning port 20, increase. When these pressures increase to an extext that surpasses the force of the spring 60*a* of the cracking valve 44*a*, the valve member 56*a* of the cracking valve is moved in the right direction in FIG. 2 to open the cracking valve 44*a*. When the cracking valve 44*a* is opened, the pressure oil within the chamber 12 flows from the line 38 to the pressure oil passageway 63*a* through the bore 54*a* of the cracking valve 44*a*, and passes through the orifice 72*a*. At the same time, the valve member 66*a* of the relief valve 46*a* is moved in the right direction in FIG. 2 to open the relief valve 46*a* (note that the rated pressure of the relief valve 46*a* is lower than the opening pressure of the cracking valve 44*a*). Thus, the pressure oil within the chamber 12 reaches the line 36 through the relief valve 46*a* and an orifice formed in a main body of the valve, and flows into the chamber 10 from the cushioning port 16. When the pressure oil flows through the relief valve 46*a* and the orifice 72*a*, the flow of the oil is restricted by the relief valve 46*a* and the orifice 72*a* thereby to absorb inertial energy accompanying the shaft 6. The cracking valve 44*a* remains open even when the pressure inside the chamber 12 becomes lower than the opening pressure of the cracking valve 44*a* by the flowing of the pressure oil from the chamber 12 to the chamber 10. When the pressure inside the chamber 12 is reduced to the rated pressure of the relief valve 46*a* (which is lower than the opening pressure of the cracking valve 44*a* and higher than its closing pressure), the valve member 66*a* is returned to the position shown in FIG. 2 by the action of the spring 70*g* to close the relief valve 46*a*. But the pressure oil within the chamber 12 flows into the chamber 10 through the orifice 72*a* formed in the valve member 66*a*, and therefore by the flow restricting action of the orifice 72*a*, the inertial energy accompanying the shaft 6 is continuously absorbed. When the inertial energy of the shaft 6 has been fully absorbed, and the amount of the pressure oil flowing from the chamber 12 to the chamber 10 through the cracking valve 44*a* becomes very small, the valve member 56*a* of the cracking valve 44*a* is returned to the position shown in FIG. 2 by the action of the spring 60*a*, and the cracking valve 44*a* is closed. Since at this time, almost all of the inertial energy accompanying the shaft 6 has been absorbed, the shaft 6 is stopped very smoothly at its stroke end.

When the control valve 26 is moved in the direction shown by a dotted-line arrow in order to rotate clockwise the shaft 6 which has been stopped in its stroke end in the counterclockwise direction, the pressure oil from the pump flows into the chamber 12 from the cushioning port through the line 24 and a check valve 34 (at the stroke end, the main port 18 is closed by the vane 8). At the same time, the pressure oil in the chamber 10 is returned to the reservoir from the main port 14 through the line 22. This results in the rotation of the shaft 6 in the direction shown by a dotted-line arrow. When the shaft 6 has rotated to some extent in the direction shown by a dotted-line arrow, the main port 18 is opened, and the pressure oil from the pump flows into the chamber 12 chiefly from the main port 18. When the control valve 26 is set at its neutral position (the position illustrated in FIG. 1) in order to stop the shaft 6 during its stroke, for example, at the time of the shaft 6 being situated at the position shown in FIGS. 1 and 2, the main port 14 of the chamber 10 and the main port 18 of the chamber 12 are closed. Even then, the shaft 6 remains rotating in the direction shown by a dotted-line arrow by the inertial energy accompanying the shaft 6. As a result, the pressure inside the chamber 10, and therefore, the pressure of the line 36 increase. When these pressures increase to the extent of surpassing the force of the spring 60*b* of the cracking valve 44*b*, the valve member 56*b* of the cracking valve 44*b* is moved in the left direction in FIG. 2 to open the cracking valve 44*b*. When the cracking valve 44*b* is opened, the pressure oil within the chamber 10 reaches the pressure oil passageway 63*b* from the line 38 through the bore 54*b* of the valve 44*b*, and flows through the orifice 72*b*. At the same time, the valve member 66*b* of the relief valve 46*b* is moved in the right direction in FIG. 2 to open the relief valve 46*b* (note that the rated pressure of the relief valve 46*b* is lower than the opening pressure of the cracking valve 44*b*). Thus, the pressure oil in the chamber 10 passes through the relief valve 46*b* and the orifice formed in the valve member and reaches the line 36. Then, the pressure oil flows from the cushioning port 20 into the chamber 12. When the pressure oil flows through the relief valve 46*b* and the orifice 72*b*, the flow of the pressure oil is restricted by the relief valve 46*b* and the orifice 72*b*, whereby the inertial energy accompanying the shaft 6 is absorbed. Even when the pressure inside the chamber 10 is reduced below the opening pressure of the cracking valve 44*b* as a result of the flowing of the pressure oil from the chamber 10 to the chamber 12, the cracking valve 44*b* remains open. When the pressure inside the chamber 10 decreases to the predetermined pressure of the relief valve 46*b* (which is lower than the opening pressure of the cracking valve 44*b* and higher than its closing pressure), the valve member 66*b* of the relief valve 46*b* is returned to the position shown in FIG. 2 by the action of the spring 70*b* to close the relief valve 46*b*. However, the pressure oil within the chamber 10 flows into the chamber 12 through the orifice 72*b* formed in the valve member 66*b*, and therefore, by the flow restricting action of the orifice 72*b*, the inertial energy accompanying the shaft 6 continues to be absorbed. When the inertial energy of the shaft 6 has been fully absorbed and the amount of the pressure oil flowing from the chamber 10 into the chamber 12 through the cracking valve 44*b* is very much reduced, the valve member 56*b* of the cracking valve 44*b* is returned to the position shown in FIG. 2 by the action of the spring 60*b* to close the cracking valve 44*b*. Since at this time, the inertial energy of the shaft 6 has been absorbed almost completely, the shaft 6 is stopped at the desired position in its stroke very smoothly.

Even when orifice 72*b* is not provided in the valve members 66*a* and 66*b* of the relief valves 46*a* and 46*b*, the pressures of the relief valves 46*a* and 46*b* can be predetermined at a very low level without causing a loss in pressure. Therefore, the inertial energy accompanying the output means can be absorbed to a considerable extent, and the stopping of the output means can be effected more smoothly than in the conventional device.

A reciprocatingly straight-moving hydraulic actuator constructed in accordance with the present invention will be described below by referrence to FIG. 3.

Figure 3:
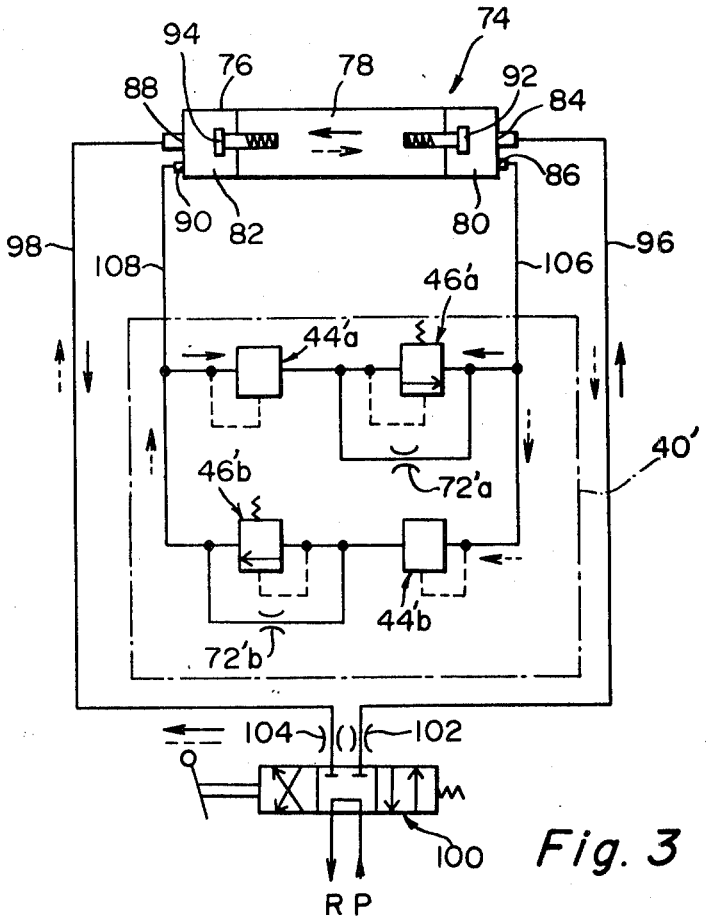
FIG. 3 illustrates a simplified hydraulic circuit of a reciprocatingly straight-moving hydraulic actuator of this invention equipped with a cushioning means.

A reciprocatingly straight-moving hydraulic actuator 74 shown in FIG. 3 includes a main body 76, a piston (output means) 78 disposed reicprocably within the main body 76, and two pressure oil chambers 80 and 82 defined by the piston within the main body 76. The piston 78 is connected to an implement (not shown) to be operated, and reciprocatingly moves it. When it is necessary to rotate the implement reciprocatingly, the piston is connected to the implement through a suitable connecting mechanism to move the implement reciprocatingly. The chamber 80 includes a main port 84 and a cushioning port 86, and the chamber 82 includes a main port 88 and a cushioning port 90. To the ends of the piston 78 are secured members 92 and 90 which serve to close the main port of the chamber on the discharge side when the piston 78 approaches its stroke end. The main port 84 of the chamber 80 and the main port 88 of the chamber 82 are connected to a pressure oil source (that is, a pump) and a reservoir through a control valve 100, for example, a control valve of the 4-port 3-position spring center type, by means of lines 96 and 98, respectively. Orifices 102 and 104 are provided respectively in the lines 96 and 98 so as to reduce the pressure acting on the actuator to a suitable level. The cushioning port 86 of the chamber 80 is connected to the cushioning port 86 of the chamber 82 by means of lines 106 and 108 through a cushioning means generally shown at 40′. The cushioning means 40′ is of the same structure as the cushioning means 40 illustrated in FIGS. 1 and 2, and its details will not be made in this specification. The constituent elements of the cushioning means 40′ are shown by the same numerals as used to indicate the elements of the cushioning means 40 shown in FIGS. 1 and 3 but with primes attached thereto.

The operation of the reciprocatingly straight-moving hydraulic actuator illustrated in FIG. 3 is substantially the same as that of the reciprocatingly rotating hydraulic actuator shown in FIGS. 1 and 2.

Figure 4:
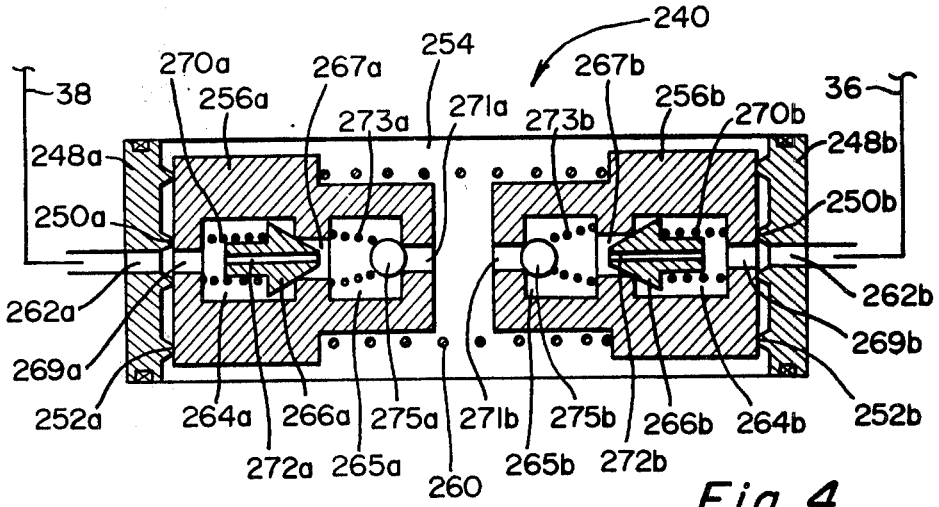
FIG. 4 is a sectional view showing a modified example of cushioning means.

A modified embodiment of the cushioning means is illustrated in FIG. 4. In the cushioning means 240 shown in FIG. 4 the first cushioning section and the second cushioning section are combined into a unitary structure to make it compact. The cushioning means 240 includes a cylindrical bore 254 having valve seats 248*a* and 248*b* provided at its ends. The valve seats 248*a* and 248*b* have two concentric annular projections 250*a* and 252*a*, and 250*b* and 252*b*, respectively at their inner surfaces, respectively, in the same way as shown in FIG. 2. Furthermore, the valve seats 248*a* and 248*b* have formed at their central parts openings 262*a* and 262*b* respectively which communicate with the lines 36 and 38. In the bore 254, a pair of opposing cracking valve members 256*a* and 256*b* are disposed. These cracking valve members 256*a* and 256*b* are urged by a compression spring 260 in the mutually departing directions, and are pushed against the valve seats 248*a* and 248*b*. The cracking valve member 256*a* has two bores 264*a* and 265*a* therein, which are connected to each other by an opening 267*a* (a smaller-diameter portion). The bore 264*a* is connected to an opening 262*a* of the valve seat 248*a* and a line 38 by an opening 269*a* provided at the bottom of the cracking valve member 256*a*. The bore 265*a* is connected to the bore 254 by means of an opening 271*a* provided at the top of the cracking valve member 256*a*. Within the bore 264*a*, a relief valve 266*a* urged in the right direction in FIG. 4 by means of a compression spring 270 is disposed. Preferably, the relief valve member 266*a* has an orifice 272*a* extending therethrough. A check ball 275*a* urged in the right direction in FIG. 4 by means of a compression spring 273*a* and closing the opening 271*a* is disposed within the bore 265*a*. In the same way as the cracking valve member 56*a* illustrated in FIG. 2, the cracking valve member 256*a* is moved in the right direction of FIG. 2 in resistance to the action of the spring 260 when the pressure inside the line 38 exceeds a rated value, and is thus opened. Once it has been moved in the right direction, it remains open until the pressure inside the line 38 decreases to a value considerably lower than the above rated pressure, preferably to a value near zero. The rated pressure of the relief valve member 266*a* is adjusted to a value lower than the opening pressure of the cracking valve member and higher than its closing pressure. The check ball 275*a* is moved in the left direction in FIG. 4 by the application of the slight pressure. Since the cracking valve member 256*b* is the same as the cracking valve member 256*a* except that it is reversed, the description of the details of this cracking valve member 256*a* will be omitted.

The operation of the cushioning means 240 will be apparent from the above description, but will be briefly described below.

When the pressure of the line 38 increases beyond a predetermined value, the cracking valve member 256*a* is moved in the right direction against the spring 260, and the pressure oil in the line 38 flows into the bore 254. The pressure oil that has flowed into the bore 254 moves the check ball 275*b* in the right direction to open the opening 271*b*, and moves the relief valve 266*b* in the right direction to open it. Thus, it flows into the line 36 through the bore 264*b* and the orifice 272*b*. Even when the pressure in the line 38 decreases to below the above rated pressure, that is the opening pressure of the cracking valve, the cracking valve member 256*a* remains open. When the pressure inside the line 38 decreases to below the rated pressure of the relief valve member 266*b*, the relief valve member 266*b* is returned to the position shown in FIG. 4. However, the pressure oil from the line 38 continues to flow into the line 36 through the orifice 272*b*. When the pressure inside the line 38 further decreases to the closing pressure of the cracking valve, the cracking valve member 256*a* is returned to the position shown in FIG. 4, and so is the check ball 275*b*. When the pressure of the line 36 exceeds the predetermined value, the flow of the pressure oil is reversed. It it obvious that the inertial energy accompanying the output means is absorbed by the oil flow restricting action of the relief valve and the orifice.

Figure 5:
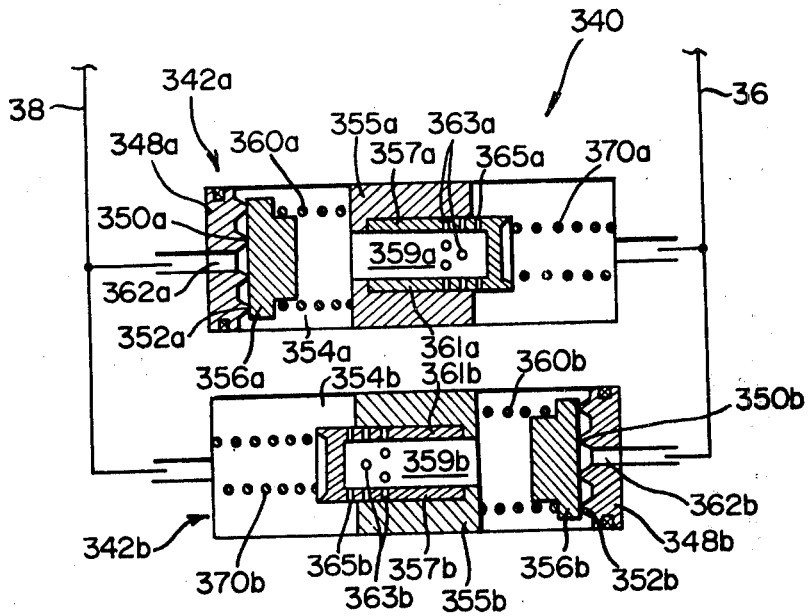
FIG. 5 is a sectional view showing another modified example of cushioning means.

FIG. 5 illustrates a cushioning means 340 obtained by somewhat modifying the cushioning means 40 illustrated in FIG. 2. Same as in the case of the cushioning means 40 shown in FIG. 2, the cushioning means 340 shown in FIG. 5 consists of a first cushioning section 342*a* and a second cushioning section 342*b*. The first cushioning section 342*a* has a cylindrical bore 354*a* having a valve seat 348*a* disposed at its one end. The valve seat 348*a*, same as the valve seat 48*a* shown in FIG. 2, includes two concentric annular projections 350*a* and 352*a* and an opening 362*a*. At the central part of the bore 354*a*, an annular member 355*a* having an outside diameter substantially corresponding to the inside diameter of the bore 354*a* is provided. This annular member 355*a* has formed therein a bore 359*a* of a stepwise structure caused by a shoulder 357*a*. Between the valve seat 348*a* and the annular member 355*a*, a cracking valve member 356*a* urged against the valve seat 348*a* by the compression spring 360*a* is provided. Within the bore 359*a* of the annular member 355*a*, a member 361*a* whose one end is urged against the shoulder 357*a* by the compression spring 370*a* is disposed. The member 361*a* includes a plurality of orifices 363*a* which are closed when its one end is urged against the shoulder 357*a* by the compression spring 370*a*, but are open when the member 361*a* is moved in the right direction in FIG. 5, and a plurality of normally open orifices 365*a*. The other end of the bore 354*a* opposite to the end at which the valve east 348*a* is disposed communicates with the line 36.

The member 361*a* is moved in the right direction in FIG. 5 when the pressure acting on the left side in FIG. 5 becomes lower than the opening pressure of the cracking valve member 356*a* and higher than the closing pressure of the cracking valve member 356*a*. When this pressure becomes lower than the above rated pressure, the member 361*a* is returned to the state shown in FIG. 5. The second cushioning section 342*b* is the same as the first cushioning section 342*a* except that it is reversed.

The operation of the cushioning means 340 shown in FIG. 5 will be briefly described below.

When the pressure inside the line 38 becomes higher than the opening pressure of the cracking valve, the cracking valve member 356*a* moves in the right direction against the spring 360*a*, and opens. Thus, the pressure oil within the line 38 flows into the bore 354*a*, and causes the member 361*a* to move in the right direction. Thus, the pressure oil that has flowed into the bore 354*a* flows into the line 36 through the orifices 363*a* and 365*a*. When the pressure on the side of the line 38 becomes below the rated pressure of the member 361*a*, the member 361*a* is returned to the position shown in FIG. 5. Since the orifices 365*a* are open even when the member 361*a* has returned to the position shown in FIG. 5, the pressure oil flows into the line 36 from the line 38 through the orifices 365*a*. When the pressure on the side of the line 38 further decreases and becomes lower than the closing pressure of the cracking valve, the cracking valve member 356*a* is returned to the position shown in FIG. 5. When the pressure on the side of the line 36 increases, the second cushioning section 342 acts in the same way. Needless to say, the inertial energy accompanying the output means is abosrbed by the oil flow restricting action of the orifices 363*a* and the orifices 365*a*.

Figure 6:
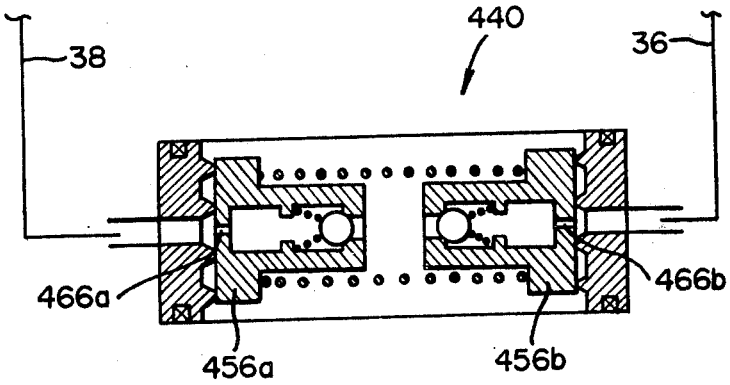
FIG. 6 is a sectional view of still another example of cushioning means.

A cushioning means 440 shown in FIG. 6 results from the omission of the relief valve members 266*a* and 266*b* from the cushioning means 240 shown in FIG. 4. The cushioning means 440 differs from the cushioning means 240 shown in FIG. 4 in that the diameters of the openings at the bottom of the cracking valve members 456*a* and 456*b* are reduced to form orifices 466*a* and 466*b* in addition to the omission of the relief valve members 456*a* and 456*b*.

In the cushioning means 440, the inertial energy accompanying the output means is absorbed by the oil flow restricting action of the orifices 466*a* and 466*b*.

While the present invention has been described with reference to some preferred embodiments, the invention is not limited to these specific structures, but any changes and modifications are possible so long as they do not depart from the spirit and scope of the present invention.

What I claim is:

1. A hydraulic actuator comprising a main body, output means reciprocably disposed within said main body and first and second chambers defined by said output means within said main body, said first chamber having a first main port which is closed when said output means approaches one end of its stroke and a first cushioning port disposed so that it remains open after said first main port has been closed, said second chamber having a second main port which is closed when said output means approaches the other end of its stroke and a second cushioning port disposed so that it remains open after said second main port has been closed, and said first and second main ports being connected by control valve means to a source of pressurized fluid including a reservior, cushioning means for connecting said first cushioning port and said second cushioning port to each other independently of said control valve means, and said cushioning means comprise a first cracking valve responsive to open at a first predetermined pressure and is responsive to close at a second predetermined pressure lower than said first predetermined pressure, first restricting means including a relief valve whose rated pressure is lower than the first predetermined pressure, said first restricting means, in series with said first cracking valve means which restricts the flow of pressurized fluid from said first cushioning port to said second cushioning port while said first cracking valve is open, a second cracking valve responsive to open when the pressure on the side of said second cushioning port reaches said first predetermined pressure and is responsive to close at a pressure lower than said first predetermined pressure, and a second restricting means including a relief valve whose rated pressure is lower than the first predetermined pressure, said restricting means in series with the said second cracking valve which restricts the flow of the fluid from said second cushioning port to said first cushioning port while said second cracking valve is open.

2. The hydraulic actuator of claim 1 wherein said hydraulic actuator is of the reciprocatingly rotating type, and each of the first and second cushioning ports are connected to said control valve through a check valve which permits the flowing of fluid from the control valve to each of said chambers, but prevents the flow of fluid from each of said chamber to said control valve.

3. The hydraulic actuator of claim 1 which is of the reciprocating straight-moving type.

4. The hyraulic actuator of claim 1 wherein the valve members of said relief valves have an orifice formed therein so as to extend therethrough, and the rated pressure of the relief valves is lower than the first predetermined pressure and higher than the second predetermined pressure.

5. The hydraulic actuator of claim 1 wherein each of the first and second restricting means include orifices.

6. The hydraulic actuator of claim 1 wherein each of said first and second restricting means comprises a combination of a relief valve and an orifice, and the rated pressure of the relief valve is lower than the first predetermined pressure and higher than the second predetermined pressure.

7. A hydraulic actuator comprising a main body, an output means reciprocably disposed within said main body and first and second chambers defined by said output means within said main body, said first chamber having a first main port which is closed by said output means when it approaches one end of its stroke and a first cushioning port that remains open after said first main port has been closed, said second chamber having a second main port which is closed by said output means when it approaches the other end of its stroke and a second cushioning port provided remains open after said second main port has been closed, control means including a directional control valve connecting said first and second main ports to a source of pressurized fluid cushioning means connecting said first and said second cushioning ports with one another, said cushioning means comprises first and second cushioning sections disposed in parallel between said cushioning ports, said first cushioning section including a first cracking valve responsive to open when the pressure on the first cushioning port exceeds a first predetermined pressure and is responsive to close at a second predetermined pressure lower than the first predetermined pressure, a first restricting means including a relief valve having a rated pressure lower than said first predetermined pressure and higher than said second predetermined pressure and normally open orifices formed in the valve member of said relief valve, said first restricting means in series with said first cracking valve which restricts the flow of fluid from said first cushioning port to said second cushioning port while the first cracking valve is open, and said second cushioning section including a second cracking valve which opens when the pressure on said second cushioning port exceeds said first predetermined pressure and is closed when said pressure becomes lower than said second predetermined pressure and a second restricting means including a relief valve having a rated pressure lower than said first predetermined pressure and higher than said second predetermined pressure and normally open orifices formed in the valve member of said relief valve, said second restricting means in series with said second cracking valve which restricts the flow of fluid from said second cushioning port to said first cushioning port when said second cracking valve is open.

8. The hydraulic actuator of claim 7 wherein each of said first and second restricting means comprises at least one orifice which is opened at a third predetermined pressure which is lower than said first predetermined pressure and higher than said second predetermined pressure and at least one orifice which is normally open.

9. A hydraulic actuator comprising a main body, an output means reciprocably disposed within said main body, first and second chambers defined by said output means within said main body, said first chamber having a first main port which is closed by said output means as it approaches one end of its stroke and a first cushioning port that remains open after said first main port has been closed, said second chamber having a second main port which is closed by said output means as it approaches the other end of its stroke and a second cushioning port that remains open after said second main port has been closed, and said first and second main ports being connected to a source of pressurized fluid by a directional control valve, cushioning means connecting said first and second cushioning ports, said cushioning means comprising a bore having a first cracking valve seat at its one end and a second cracking valve seat at its other end, said first cracking valve seat having two concentric annular projections in its inner surface and a through opening at the center thereof, said opening having a diameter not exceeding the diameter of one of said two annular projections which is situated more inwardly and communicating with said first cushioning port, said second cracking valve seat having two concentric annular projections in its inner surface and a through opening at the center thereof, said opening having a diameter not exceeding the diameter of the one of said two annular projections which is situated more inwardly and communicating with said second cushioning port, first and second cracking valve members disposed within said bore, and a compression spring disposed between said first and second cracking valve members and urging said first cracking valve member against the annular projections of said first cracking valve seat and said second cracking valve member against the annular projections of said second cracking valve seat, each of said first and second cushioning means including a flow passageway communicating with said bore, and a check valve for permitting the flow of fluid from the bore to said opening of the valve seat but preventing flow from said opening of the valve seat to said bore, said passageway including therein restricting means including a relief valve disposed in said flow passageway and having a rated pressure lower than the opening pressure of said cracking valve member for restricting the flow of fluid passing therethrough.

10. The hydraulic actuator of claim 9 wherein the prescribed pressure of the relief valve is higher than the closing pressure of said cracking valve members, and the valve member of said relief valve has formed therein a through orifice.

11. The hydraulic actuator of claim 9 wherein said restricting means comprises orifices disposed in said flow passageway.

* * * * *